US007577495B2

(12) United States Patent
Glöss et al.

(10) Patent No.: US 7,577,495 B2
(45) Date of Patent: Aug. 18, 2009

(54) SPEED MONITORING METHOD IN AN AUTOMATION SYSTEM FOR A CONVEYOR INSTALLATION

(75) Inventors: Gerhard Glöss, Essen (DE); Markus Haala, Erlangen (DE); Bernhard Tüshaus, Dorsten (DE)

(73) Assignee: Siemens Aktiengesellschaft, Munich (DE)

( * ) Notice: Subject to any disclaimer, the term of this patent is extended or adjusted under 35 U.S.C. 154(b) by 192 days.

(21) Appl. No.: 11/792,325

(22) PCT Filed: Dec. 1, 2005

(86) PCT No.: PCT/EP2005/056367

§ 371 (c)(1),
(2), (4) Date: Jun. 5, 2007

(87) PCT Pub. No.: WO2006/061346

PCT Pub. Date: Jun. 15, 2006

(65) Prior Publication Data

US 2008/0262647 A1 Oct. 23, 2008

(30) Foreign Application Priority Data

Dec. 6, 2004 (DE) ..... 10 2004 058 756

(51) Int. Cl.
*B66B 5/06* (2006.01)

(52) U.S. Cl. ..... 700/230; 187/293; 187/393

(58) Field of Classification Search ..... 700/230; 187/293, 294, 393, 394
See application file for complete search history.

(56) References Cited

U.S. PATENT DOCUMENTS

| | | | | |
|---|---|---|---|---|
| 3,814,216 | A * | 6/1974 | Pisatowski | 187/393 |
| 4,161,236 | A * | 7/1979 | Husson | 187/294 |
| 4,378,059 | A | 3/1983 | Hatakeyama et al. | |
| 4,503,939 | A | 3/1985 | Lawrence et al. | |
| 4,959,808 | A | 9/1990 | Neuffer et al. | |
| 5,070,967 | A | 12/1991 | Katzy et al. | |
| 5,648,645 | A * | 7/1997 | Arpagaus et al. | 187/393 |
| 6,170,614 | B1 * | 1/2001 | Herkel et al. | 187/287 |
| 7,438,158 | B2 * | 10/2008 | Heinzer et al. | 187/248 |

FOREIGN PATENT DOCUMENTS

| | | | |
|---|---|---|---|
| DE | 101 46 044 | A1 | 4/2003 |
| EP | 0 380 802 | A1 | 8/1990 |
| EP | 0 289 813 | B1 | 9/1991 |
| EP | 1 431 229 | A1 | 6/2004 |
| JP | 2003327369 | A1 | 11/2003 |
| WO | WO 2004/028947 | A1 | 4/2004 |

* cited by examiner

*Primary Examiner*—Mark A Deuble

(57) ABSTRACT

The invention relates to a speed monitoring method in a automation system for a conveyor installation, particularly for a pit. A speed monitoring method is provided that eliminates the need for detection elements for determining position that are arranged along the path of conveyance. An actual path value and an actual speed value are determined by means of at least one pulse counter. The actual path value is used for reading out a speed limiting value from a data table, which is stored in the automation system and which represents a stepped limiting value curve and for comparing the actual speed value with the read out speed limiting value.

10 Claims, 2 Drawing Sheets

SPEED MONITORING METHOD IN AN AUTOMATION SYSTEM FOR A CONVEYOR INSTALLATION

CROSS REFERENCE TO RELATED APPLICATIONS

This application is the US National Stage of International Application No. PCT/EP2005/056367, filed Dec. 1, 2005 and claims the benefit thereof. The International Application claims the benefits of German application No. 10 2004 058 756.6 filed Dec. 6, 2004, both of the applications are incorporated by reference herein in their entirety.

FIELD OF INVENTION

The invention relates to a speed monitoring method in an automation system for a conveyor installation, particularly for a pit.

BACKGROUND OF THE INVENTION

Such a method is known from EP 0 289 813 B1. The method described there already operates very safely.

For areas such as an upper or a lower end area of a shaft or an accessible intermediate destination however, in view of safety considerations, particularly strict regulations apply with regard to speed monitoring. The speed monitoring must be undertaken here in two independent ways. A first type of monitoring implemented in conveyor installations is by comparing an actual speed value, which has been determined for example by a pulse counter mounted on a drive shaft of a motor, with a speed value calculated in the automation system. Another is for detection elements, such as magnets or end position switches or light barriers, to be used along the conveyor path for additional path and speed monitoring of conveyor means. A pulse issued by a detection element notifies the automation system about the instantaneous location of the conveyor means. A maximum permitted speed value belonging to this location is compared to the actual speed value. A second type of protection is thus implemented in the automation system.

SUMMARY OF INVENTION

The object of the invention is to specify a speed monitoring method which, unlike the prior art, can operate with a speed monitoring method which is independent of detection elements arranged along the conveyor path and yet still meets especially high safety requirements.

The object is achieved by a speed monitoring method in an automation system for a conveyor installation, especially for a pit, in which an actual path value and an actual speed value are determined by means at least of one pulse counter, a first speed limiting value is calculated by means of a calculation instruction stored in the automation system, using the actual path value, the actual speed value is compared with the first speed value, a second speed limiting value is read out using the actual path value from a data table representing a stepped limit value curve stored in the automation system and the actual speed value is compared with the second speed limiting value.

The inventive comparison of the actual speed value with the speed value stored in the automation system advantageously enables an expensive installation of many detection elements along the conveyor path to be dispensed with. The harsh environmental conditions along the conveyor path, for example impacts from stones in the conveyed material, mean that it is very advantageous to minimize the number of detection elements along the conveyor path. Maintenance and service work and costs can thus be reduced. The redundant function type comparison of the actual speed value with two speed limiting values provided in different ways allows an especially high degree of safety to be achieved.

Advantageously the pulse counter is arranged outside the conveyor path, especially outside a shaft. As already mentioned, all elements which are arranged along the conveyor path are exposed to especially harsh conditions. Arranging the pulse counter outside the conveyor path enhances the safety of the installation in addition to making maintenance easier.

It is sensible for two or three pulse counters to be available. Speed values and path values can be determined separately in this way or additionally compared for mutual plausibility.

In a preferred embodiment of the invention the speed limiting values of the stepped limiting value curve are calculated and defined independently of the conveyor path before the start of operation and/or before the installation is first put into service. The speed limiting values of the stepped limiting value curve are preferably calculated by specifying specific conveyor path parameters, such as an end position, an preferred end position, a creepage speed, a creepage distance, a correction value, a beginning of the path curve, a reference step, a first end position, a second end position, a maximum conveyor run, a maximum conveyor speed, a maximum jolt, a maximum deceleration, an overwinding distance, preferably with a tabular file.

It is expedient for the path and speed values of the stepped limiting value curve to be predetermined as unchangeable in the automation system during operation. The installation can thus be safely operated without a malfunction being triggered by accidental overwriting of the stepped limiting value curve.

BRIEF DESCRIPTION OF THE DRAWINGS

Further advantages and inventive details emerge in conjunction with the subclaims, the drawing and the subsequent description of the exemplary embodiment. The figures show:

DETAILED DESCRIPTION OF INVENTION

Figure 1:
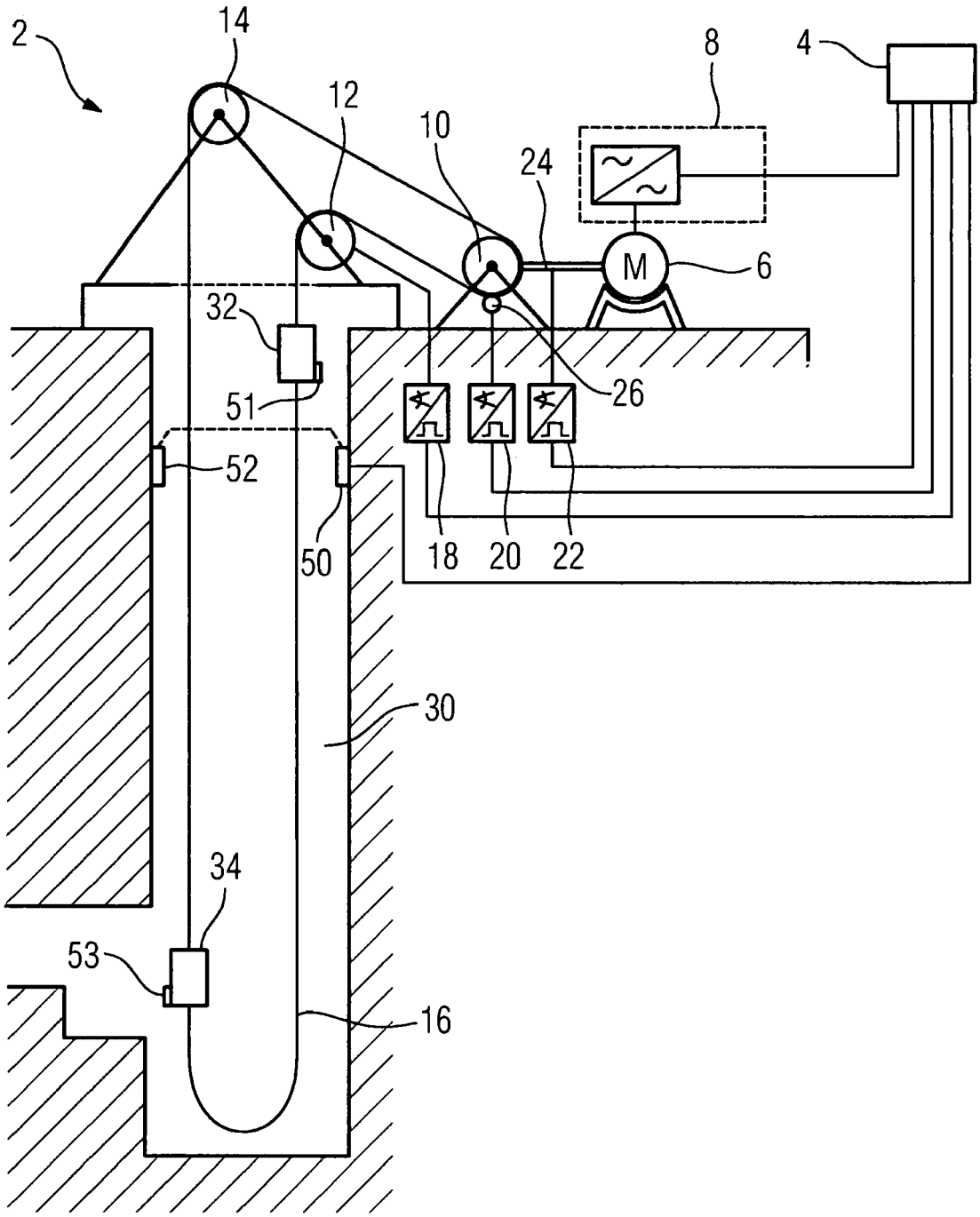
FIG. 1 a shaft conveyor installation with an automation system.

FIG. 1 shows a conveyor installation 2 with an automation system 4. The conveyor installation 2 is a shaft conveyor installation of a pit shaft which is operated via a motor 6. The rotational speed of the motor 6 is controlled by a frequency converter 8. The specifications for the speed control of the frequency converter 8 are provided by the automation system 4, which is connected to the frequency converter 8. The shaft conveyor installation 2 has two hoisting cages, cables or conveyor means 32 and which are moved with a hoisting cable 16 in the shaft 30. The hoisting cable 16 is driven via a drive sheave 10 with the motor 6 and diverted via a first cable sheave 12 and a second cable sheave 14. A first pulse counter 18, a second pulse counter 20 and a third pulse counter 22 are connected via data lines to the automation device 4.

The first pulse counter 18 detects the pulses for the path and speed values at the cable sheave 12. The second pulse counter 20 detects the pulse for the path and speed values via a friction roller 26 at the drive sheave 10. The third pulse counter detects the pulses for the path and speed values at the shaft 24 of the motor 6.

By detecting the pulses for the path and speed values at different points the automation device 4 is provided with the pulses for the path and speed values in a redundant manner. For reasons of safety and because of possible cable slippage at the drive sheave 10, the values supplied by the three pulse counters 18, 20 and 22 are checked against each other for consistency. If the values are mutually consistent, one of them or a combination of them is used as measured value for the path or the speed of the conveyor means 32 and 34. The value for the path determined in this manner then applies as the position of the conveyor means 32 and 34.

For pit conveyor installations not only material, but also personnel is conveyed at high speed, e.g. 12 m/s, with conveyor means 32 and 34. This is also referred to as rope haulage. The safety requirements for monitoring the speed of such installations, especially with rope haulage, are correspondingly high. Thus a redundant function type speed monitoring method is used. A braking path of shaft conveyor installations at the end of the shaft usually has to be very short, as a result of which the orderly deceleration of the installation must be monitored over the entire deceleration path.

By contrast with shaft conveyor systems in which the speed is monitored with numerous detection elements arranged along the conveyor path, the speed of the conveyor means 32 and 34 of this installation are monitored by a speed monitoring method which largely dispenses with the necessity for detection elements.

If however the shaft conveyor system 2 can only be operated with significant cable slippage, a positioning for the end area of the shaft by means of a single detection element 50 and 52 per conveyor means is needed. As a result of cable slippage which occurs or as a result of variations in the length of the hoisting cable 16 through sharp variations in ambient temperatures for example because of the summer and winter season, the detection elements 50 and 52 for the conveyor means 32 and 34 with their associated magnets 51 and 53 are used exclusively for synchronization of the measured conveyor path at the reference point. The detection element is thus not a component of the speed monitoring method.

Figure 2:
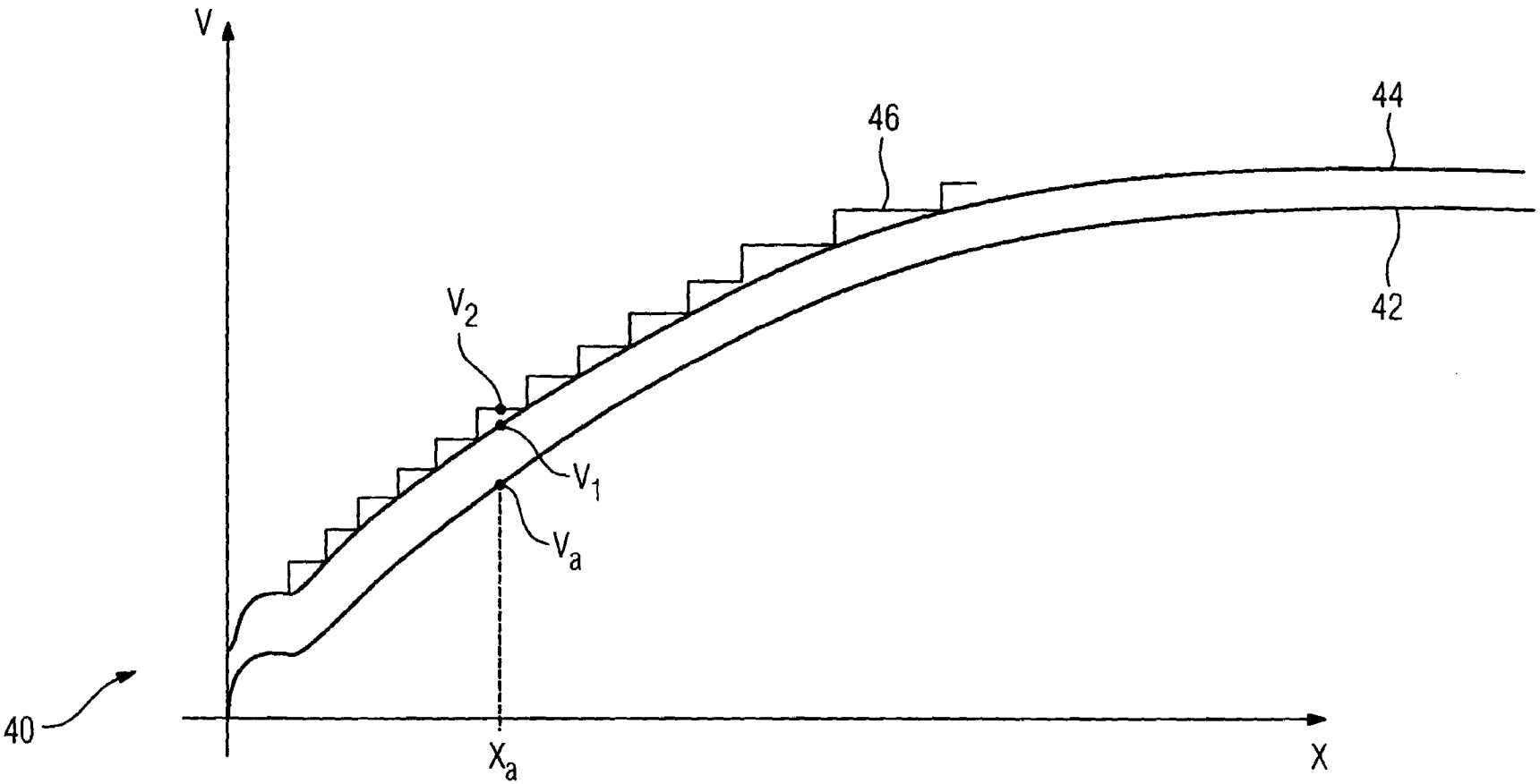
FIG. 2 a path-speed diagram.

FIG. 2 shows a path-speed diagram 40, in which the measured values $V_a$, i.e. the speed values $V_a$, which were determined by means of the pulse counter 18, 20 and 22, are plotted over the path x. At the same time an actual path value $X_a$ is determined by pulse counters 18, 20 and 22. The curve identified by reference symbol 42 is a path curve 42 consisting of the actual speed values $V_a$.

A first limiting value curve is identified by reference symbol 44. The limiting value curve 44 is formed from the first speed value $V_1$ plotted over the path x. Using the actual path value $X_a$ the respective speed limiting value $V_1$ is calculated by means of a calculation instruction stored in the automation system 4. The limiting value curve 44 with around 8 to 10 larger speed values $V_1$ forms an envelope curve for the actual path curve 42 with the speed value $V_a$.

A stepped limiting value curve 46 is a second limiting value curve calculated before the start of operation. The stepped limiting value curve 46 is calculated for example in an Excel file before start of operation and permanently stored in a data chip of the automation system 4. The base points of the stepped limiting value curve 46 correspond to the calculated limiting value curve 44. The stepped limiting value curve 46 with a maximum of 127 steps is significantly more finely graduated than with the conventional method using a stepped curve determined with detection elements arranged along the detection path. Using the actual path value $X_a$ once again a second speed limiting value $V_2$ is read out from the data chip of the automation system 4, which contains the stepped limiting value curve 46.

For speed monitoring or a comparison of the speed values an actual speed value $V_a$ and two speed limiting values $V_1$ and $V_2$ are now available. As soon as the actual speed value $V_a$ exceeds the speed limiting values $V_1$ and/or $V_2$, a braking routine necessary for the safety is initiated in the automation system 4 and output for an acoustic or optical warning signal. Since at least one of the speed limiting values $V_1$ or $V_2$ was exceeded, the installation is braked immediately and slowed down to a standstill.

The invention claimed is:

1. A method of monitoring a speed of an automated conveyor system for a pit installation, comprising:

determining a current path value and a current speed value via a pulse counter;

determining a first speed limiting value and a second speed limiting value based on the current path value, wherein:

the first speed limiting value is calculated by a computing instruction stored in the automation system with an action that influences safety in the automation system initiated if the first speed limiting value and the second speed limiting value are exceeded by the actual speed value, and the second speed limiting value is read out from a data table representing a stepped limiting value curve stored in the automation system; and comparing the first speed limiting value and the second speed limiting value with the current speed value.

2. The method as claimed in claim 1, wherein the pulse counter is arranged outside the conveyor path.

3. The method as claimed in claim 1, wherein the pulse counter is arranged outside a shaft of the installation.

4. The method as claimed in claim 2, wherein a plurality of pulse counters are present.

5. The method as claimed in claim 4, wherein the speed limiting values of the stepped limiting value curve are determined depending on the conveyor path before the start of operation and/or before the installation is first put into service.

6. The method as claimed in claim 5, wherein the path and speed values of the stepped limiting value curve are predetermined as unchangeable values in the automation system during operation.

7. The method as claimed in claim 6, wherein the path and speed values of the stepped limiting value curve are stored in a non-overwritable and/or non-erasable memory area of the automation system.

8. The method as claimed in claim 7, wherein the steps of the stepped limiting value curve are determined for 8 to 128 steps.

9. The method as claimed in claim 8, wherein different stepped limiting value curves are defined for conveying goods and people.

10. A method of monitoring a speed of an automated conveyor system for a pit installation, comprising:

determining a current path value and a current speed value via a pulse counter;

determining a first speed limiting value and a second speed limiting value based on the current path value, wherein:

the first speed limiting value is calculated by a computing instruction stored in the automation system with an action that influences safety in the automation system initiated if the first speed limiting value or the second speed limiting value are exceeded by the actual speed value, and the second speed limiting value is read out from a data table representing a stepped limiting value curve stored in the automation system; and comparing the first speed limiting value and the second speed limiting value with the current speed value.

* * * * *